US011506463B1

(12) United States Patent
Kunsky

(10) Patent No.: US 11,506,463 B1
(45) Date of Patent: Nov. 22, 2022

(54) FIREARM SUPPRESSOR

(71) Applicant: Jacob Kunsky, Bruneau, ID (US)

(72) Inventor: Jacob Kunsky, Bruneau, ID (US)

( * ) Notice: Subject to any disclaimer, the term of this patent is extended or adjusted under 35 U.S.C. 154(b) by 0 days.

(21) Appl. No.: 17/667,240

(22) Filed: Feb. 8, 2022

(51) Int. Cl.
*F41A 21/30* (2006.01)
*F41A 21/18* (2006.01)

(52) U.S. Cl.
CPC ..... *F41A 21/30* (2013.01); *F41A 21/18* (2013.01)

(58) Field of Classification Search
CPC ..... F41A 21/18; F41A 21/30–42
USPC ..... 89/14.2–14.4; 181/223; 42/78–79
See application file for complete search history.

(56) References Cited

U.S. PATENT DOCUMENTS 5,679,916 A * 10/1997 Weichert ..... F41A 21/30 181/232
6,308,609 B1 * 10/2001 Davies ..... F41A 21/30 89/14.4
6,374,718 B1 * 4/2002 Rescigno ..... F41A 21/30 89/14.4
9,097,482 B1 * 8/2015 Holden ..... F41A 21/30
10,809,033 B2 * 10/2020 Tindal ..... F41A 21/36

* cited by examiner

*Primary Examiner* — Joshua E Freeman
*Assistant Examiner* — Benjamin S Gomberg
(74) *Attorney, Agent, or Firm* — Parsons Behle & Latimer

(57) ABSTRACT

A suppressor for suppressing the discharge of a firearm. The suppressor includes a plurality of baffles positioned between a base and an end cap. The baffles and a portion of the end cap are configured to form a contiguous bore through the suppressor. The bore includes a plurality of bores to allow gasses to escape into chambers in the suppressor. The baffles include a lower cylindrical portion, an upper cylindrical portion, a plurality of holes through the upper cylindrical portion, and a cone portion. The baffles include a central bore through the upper cylindrical portion. The central bore of each baffle is aligned with the central bore of the end cap and the upper cylindrical portions are sequentially positioned to align the central bore of each baffle of the plurality of baffles with the central bore of the end cap to form the continuous bore.

19 Claims, 12 Drawing Sheets

FIREARM SUPPRESSOR

BACKGROUND

Field of the Disclosure

The examples described herein relate to apparatuses, systems, and methods of a firearm suppressor.

Description of the Related Art

A firearm suppressor is a device mounted or otherwise attached to the muzzle of a firearm and, through selective use of baffles or other gas-redirection apparatus, operates to diminish the report (as measured in decibels) of a firearm following discharge. By reducing the report of a discharging firearm, suppressors reduce or mitigate hearing damage or loss otherwise resulting from repeated exposure to firearm discharges. A suppressor may be attached to a firearm by various mechanisms.

Firearm suppressors are typically designed for firearms that discharge, or fire, bullets such as handguns and rifles. Typically, the barrel of a firearm includes rifling, or spiral grooves, in the inside of the barrel to impart spin on a projectile discharged from the firearm. The rifling may help to stabilize the projectile by improving its aerodynamic stability. Barrels include a crown at the muzzle end of the barrel. Crowns are design to moderate the gases from the discharge of the projectile to be concentric with the projectile as it leaves the barrel. A suppressor does not typically include any rifling along a projectiles flow path through the suppressor. Further, suppressors are typically attached or connected to the muzzle end of the barrel thus obscuring the effect of the crown of the barrel. The use of a suppressor on a firearm may destabilize a projectile, to some extent, after the projectile leaves the end of the barrel and travels along the bore or pathway through the suppressor.

One type of a firearm, a shotgun, does not typically fire a bullet, but typically fires shot (e.g., a plurality of lead, steel, or other metal pellets). One difficulty in designing a suppressor capable to suppress the discharge of a shotgun is that both a wad and shot are discharged. The wad is a component of the shotgun shell that is used to separate the shot from the powder. The wad provides a seal to propel the shot when the powder is discharged rather than having the gas from the discharge blowing through the shot. The wad typically is made of plastic and expands as it is being discharged from the barrel. As the wad travels along the suppressor, the wad may expand into gaps between the baffles, which is problematic. The expansion of the wad between baffles may cause the wad to strike the baffles potentially damaging the baffle and/or adding to the sound of the discharge. Other disadvantages may exist.

SUMMARY

The present disclosure is directed to apparatus, systems, and methods of a firearm suppressor.

One example of the present disclosure is a firearm suppressor that comprises a first baffle and an end cap. The first baffle includes a first lower cylindrical portion having a first end, a second end, an exterior, and an interior. The first baffle includes a first upper cylindrical portion having a first end, a second end, an exterior, an interior, and a first central bore that extends through the first upper cylindrical portion, the first central bore defined by the interior. The first baffle includes a first plurality of holes through the first upper cylindrical portion. The first baffle includes a first cone portion between the first upper cylindrical portion and the first lower cylindrical portion, the first cone portion having an exterior and an interior. The first plurality of holes provides fluid communication between the interior of the first upper cylindrical portion and the exteriors of the first upper cylindrical portion and the first cone portion.

The end cap includes an outer cylindrical portion having a first end, a second end, an exterior and an interior. The end cap includes an inner cylindrical portion having a first end, a second end, an exterior, an interior, and a central bore. The end cap includes a horizontal portion connected between the second end of the outer cylindrical portion and the second end of the inner cylindrical portion. The end cap includes a plurality of holes in the inner cylindrical portion, the plurality of holes provides fluid communication between the interior of the inner cylindrical portion and the exterior of the inner cylindrical portion. The central bore of the inner cylindrical portion of the end cap is aligned with the first central bore of the first upper cylindrical portion of the first baffle.

The firearm suppressor may include a second baffle. The second baffle includes a second lower cylindrical portion having a first end, a second end, an exterior, and an interior. The second baffle includes a second upper cylindrical portion having a first end, a second end, an exterior, an interior, and a second central bore that extends through the second upper cylindrical portion, the second central bore defined by the interior. The second baffle includes a second plurality of holes through the second upper cylindrical portion. The second baffle includes a second cone portion between the second upper cylindrical portion and the second lower cylindrical portion, the second cone portion having an exterior and an interior. The second plurality of holes provide fluid communication between the interior of the second upper cylindrical portion and the exteriors of the second upper cylindrical portion and the second cone portion.

The firearm suppressor may include a base having a first end, and second end, and a passageway through the base from the first end to the second end. The first baffle and the second baffle may be positioned between the base and the end cap. The interior of the inner cylindrical portion of the end cap may include rifling. The interior of the first upper cylindrical portion of the first baffle may include rifling. The interior of the second upper cylindrical portion of the second baffle may include rifling.

The firearm suppressor may include a shotgun mount, the shotgun mount having a first end, a second end, a central bore, first external threads adjacent to the first end, a plurality of apertures adjacent to the second end, and second external threads between the first external threads and the plurality of apertures. The first external threads may be configured to thread into choke threads in a barrel of a shotgun. The shotgun mount may include a connector, wherein the connector is connected to the shotgun mount and is connected to the base, wherein the connector is between the base and the shotgun mount and wherein the base is between the connector and the first and second baffles. The first baffle further may include a first horizontal portion connected between the first cone portion and the first end of the first lower cylindrical portion, the first horizontal portion having an interior and an exterior. The second baffle further may include a second horizontal portion connected between the second cone portion and the first end of the second lower cylindrical portion, the second horizontal portion having an interior and an exterior.

The interior of the first upper cylindrical portion of the first baffle may include a first internal shoulder. The first end of the first upper cylindrical portion of the first baffle may include a first surface and a first chamfer. The first end of the second upper cylindrical portion of the second baffle may include a second surface and a second chamfer, wherein the second surface may engage the first internal shoulder of the first upper cylindrical portion and wherein the second chamfer may engage the interior of the first cone portion. The interior of the second upper cylindrical portion may include a second internal shoulder. The second end of the inner cylindrical portion of the end cap may include a surface and a chamfer, wherein the surface may engage the second internal shoulder of the second upper cylindrical portion and wherein the chamfer may engage the interior of the second cone portion.

The firearm suppressor may include a third baffle. The third baffle includes a third lower cylindrical portion having a first end, a second end, an exterior, and an interior. The third baffle includes a third upper cylindrical portion having a first end, a second end, an exterior, an interior, and a third central bore that extends through the third upper cylindrical portion, the third central bore defined by the interior of the third upper cylindrical portion. The third baffle includes a third plurality of holes through the third upper cylindrical portion. The third baffle includes a third cone portion between the third upper cylindrical portion and the third lower cylindrical portion, the third cone portion having an exterior and an interior. The third plurality of holes provide fluid communication between the interior of the third upper cylindrical portion and the exteriors of the third upper cylindrical portion and the third cone portion.

The second end of the inner cylindrical portion of the end cap may include a surface and a chamfer, wherein the surface of the second end of the inner cylindrical portion of the end cap may engage the third internal shoulder of the third upper cylindrical portion and wherein the chamfer of the second end of the inner cylindrical portion of the end cap may engage the interior of the third cone portion. The base may include internal threads located at the second end. The first lower cylindrical portion may include external threads at the first end and internal threads at the second end. The second lower cylindrical portion may include external threads at the first end and internal threads at the second end. The third lower cylindrical portion may include external threads at the first end and internal threads at the second end. The outer cylindrical portion of the end cap may include external threads.

One embodiment of the present disclosure is a baffle for a firearm suppressor. The baffle includes a lower cylindrical portion having a first end, a second end, an exterior, and an interior. The baffle includes an upper cylindrical portion having a first end, a second end, an exterior, and an interior. The baffle includes a plurality of holes through the upper cylindrical portion. The baffle includes a cone portion positioned between the upper cylindrical portion and the lower cylindrical portion, the cone portion having an exterior and an interior. The baffle includes a central bore that extends through the upper cylindrical portion, wherein the plurality of holes provides fluid communication between the interior of the upper cylindrical portion and the exterior of the upper cylindrical portion.

The baffle may include a horizontal portion, the horizontal portion connected between the cone portion and the first end of the lower cylindrical portion. The first end of the upper cylindrical portion of the baffle may include a surface and a chamfer. The interior of the upper cylindrical portion of the baffle may include an internal shoulder adjacent to the interior of the cone portion.

One embodiment of the disclosure is a shotgun suppressor system. The system includes a shotgun mount having a first end, a second end, a central bore, a plurality of apertures adjacent the second end, first external threads, and second external threads, the first external threads being configured to connect the shotgun mount to a barrel of a shotgun via choke threads. The system includes a connector having a first end, second end, a first bore, a second bore, internal threads in the first bore, and external threads, wherein the connector is connected to the shotgun mount via the internal threads mated with the second external threads of the shotgun mount. The system includes a base having a first end, a second end, and a passageway through the base from the first end to the second end, the base connected to the external threads of the connector. The system includes an end cap, the end cap having an outer cylindrical portion, an inner cylindrical portion having a central bore; a plurality of holes in the inner cylindrical portion, and a horizontal portion connected between the outer cylindrical portion and the inner cylindrical portion, wherein the plurality of holes provides fluid communication between an interior of the inner cylindrical portion and an exterior of the inner cylindrical portion. The system includes a plurality of baffles positioned between the base and the end cap.

The baffles each include a lower cylindrical portion having a first end, a second end, an exterior, and an interior. The baffles each include an upper cylindrical portion having a first end, a second end, an exterior, and an interior. The baffles each include a plurality of holes through the upper cylindrical portion. The baffles each include a cone portion positioned between the upper cylindrical portion and the lower cylindrical portion, the cone portion having an exterior and an interior. The baffles each include a central bore that extends through the upper cylindrical portion. The plurality of holes provides fluid communication between the interior of the upper cylindrical portion and the exteriors of the upper cylindrical portion and the cone portion. The central bore of each baffle of the plurality of baffles is aligned with the central bore of the end cap. The upper cylindrical portions of the plurality of baffles are sequentially positioned to align the central bore of each baffle of the plurality of baffles with the central bore of the end cap to form a continuous bore.

The central bore of the inner cylindrical portion of the end cap may be configured to be an improved cylinder choke, a modified choke, or a full choke. Each of the baffles of the plurality of baffles may include a horizontal portion connected between the cone portion and the first end of the lower cylindrical portion. Each of the baffles of the plurality of baffles may include a surface and chamfer at the first end of the upper cylindrical portion and an internal should on the exterior of the upper cylindrical portion. The internal shoulder may be adjacent to the cone portion with the surface being shaped complementary to the internal shoulder. The second end of the shotgun mount may include breeching teeth. The shotgun mount may include a locking chamfer.

One embodiment of the disclosure is an end cap for a firearm suppressor. The end cap includes an outer cylindrical portion having a first end, a second end, an exterior, and an interior. The end cap includes an inner cylindrical portion having a first end, and second end, an exterior, an interior, and a central bore. The end cap includes a horizontal portion connected between the second end of the outer cylindrical portion and the second end of the inner cylindrical portion.

The end cap may include a plurality of holes in the inner cylindrical portion, the plurality of holes provides fluid communication between the interior of the inner cylindrical portion and the exterior of the inner cylindrical portion. The interior of the inner cylindrical portion may include threads configured to receive a shotgun choke. The central bore of the inner cylindrical portion may be configured to be an improved cylinder choke, a modified choke, or a full choke. The interior of the inner cylindrical portion may include rifling.

As used herein, the term "continuous bore" means a bore that may include one or more seams along its length but does not include any appreciable gaps from end to end. Each of the baffles of the plurality of baffles may include a horizontal portion connected between the cone portion and the first end of the lower cylindrical portion. Each of the baffles of the plurality of baffles may include a surface and a chamfer at the first end of the upper cylindrical portion and an internal shoulder on the exterior of the upper cylindrical portion, the internal shoulder being adjacent to the cone portion, the surface being shaped complementary to the internal shoulder.

One embodiment of the present disclosure is a firearm suppressor that includes a plurality of baffles and an end cap, wherein the plurality of baffles and the end cap form a continuous bore. The continuous bore may be a smooth bore. The firearm suppressor may include a base configured to connect the firearm suppressor to the barrel of a firearm. Portions of the continuous bore may include rifling. In an embodiment, the entire continuous bore may include rifling. The end cap may be the only portion of the firearm suppressor that includes rifling. One or more of the baffles may include rifling. The rifling may be polygonal rifling, gain-twist or progressive rifling, helical grooves, or the like. The end cap of the firearm suppressor may include a crown. The crown may be a target crown, recessed crown, eleven (11) degree crown, concave and recessed crown, or the like.

An embodiment of the present disclosure is a suppressor for a shotgun that includes one or more baffles and an end cap with a portion of the end cap including a shotgun choke, which may be but is not limited to a cylinder choke, an improved cylinder choke, a modified choke, an improved modified choke, or a full choke. The suppressor may include a base configured to connect the shotgun suppressor to the barrel of a shotgun. The suppressor may include an adapter and/or a shotgun mount. The shotgun mount may thread into choke threads inside of a shotgun barrel. One embodiment of the present disclosure is a suppressor for a shotgun that includes one or more baffles and an end cap that is configured for the insertion of a shotgun choke into the end cap. The end cap of the shotgun suppressor may include a crown.

An embodiment of the present disclosure is a firearm suppressor configured to be attached to the end of a firearm barrel, the firearm suppressor including one or more baffles and an end cap with a projectile path through the one or more baffles and the end cap. At least a portion of the projectile path includes rifling. The projectile path through the end cap may be rifling and/or the projectile path through one or more baffles may be rifled. The rifling may be polygonal rifling, gain-twist or progressive rifling, helical grooves, or the like. The end cap may include a crown, such as but not limited to, a target crown, recessed crown, eleven (11) degree crown, concave and recessed crown, or the like.

One embodiment of the disclosure is an end cap for a firearm suppressor. The end cap includes an outer cylindrical portion having a first end, a second end, an exterior, and an interior. The outer cylindrical portion include external threads and internal threads. The end cap includes an inner cylindrical portion having a first end, and second end, an exterior, an interior, and a central bore. The inner cylindrical portion is a separate component from the outer cylindrical portion. The inner cylindrical portion includes external threads configured to mate with the internal threads of the outer cylindrical portion. The end cap includes a horizontal portion connected to the second end of the outer cylindrical portion.

The inner cylindrical portion includes a horizontal member located at the second end of the inner cylindrical portion. The horizontal member extends away from the inner cylindrical portion. The horizontal member may be substantially perpendicular to the inner cylindrical portion. The inner cylindrical portion includes a vertical member located at the end of the horizontal member that extends away from the horizontal member. The vertical member may be substantially parallel to the inner cylindrical portion and extend in the same direction as the first end of the inner cylindrical portion. The vertical member includes external threads that are configured to mate with the internal threads of the outer cylindrical portion. In this way, different inner cylindrical portions may be swapped out with a single outer cylindrical portion of the end cap.

The inner cylindrical portion may include a plurality of holes that provides fluid communication between the interior of the inner cylindrical portion and the exterior of the inner cylindrical portion when the inner cylindrical portion is threaded into the outer cylindrical portion. The inner cylindrical portion may be configured to be an improved cylinder choke, a modified choke, a full choke, or the like. As the inner cylindrical portion is threaded into the outer cylindrical portion, the inner cylindrical portion may be removed to change the type of choke in the end cap. The interior of the inner cylindrical portion may include rifling. Likewise, an inner cylindrical portion having a bore with a first inner diameter may be swapped with an inner cylindrical portion having a bore with a second inner diameter that differs from the first inner diameter. In this way, the end cap may be used with different firearm suppressors for different calibers and the projectile path through the end cap may be modified by simply swapping out the inner cylindrical portion. Likewise, the crown at the end of the end cap may be modified by swapping out different inner cylindrical portions by simply unthreading a first inner cylindrical portion and threading into the outer cylindrical portion a second inner cylindrical portion. The threaded inner cylindrical portion enables modification of the end cap and/or firearm suppressor as would be appreciated by one of ordinary skill in the art having the benefit of this disclosure. The first end 321 of the inner cylindrical portion 320 may include a flat or surface 327 that is configured to mate or engage with an internal shoulder 226 of an adjacent baffle 200. The first end 321 of the inner cylindrical portion 320 may also include a chamfer 328 that is configured to engage or mate with an interior 242 of a cone portion 240 of an adjacent baffle 200.

Figure 1:
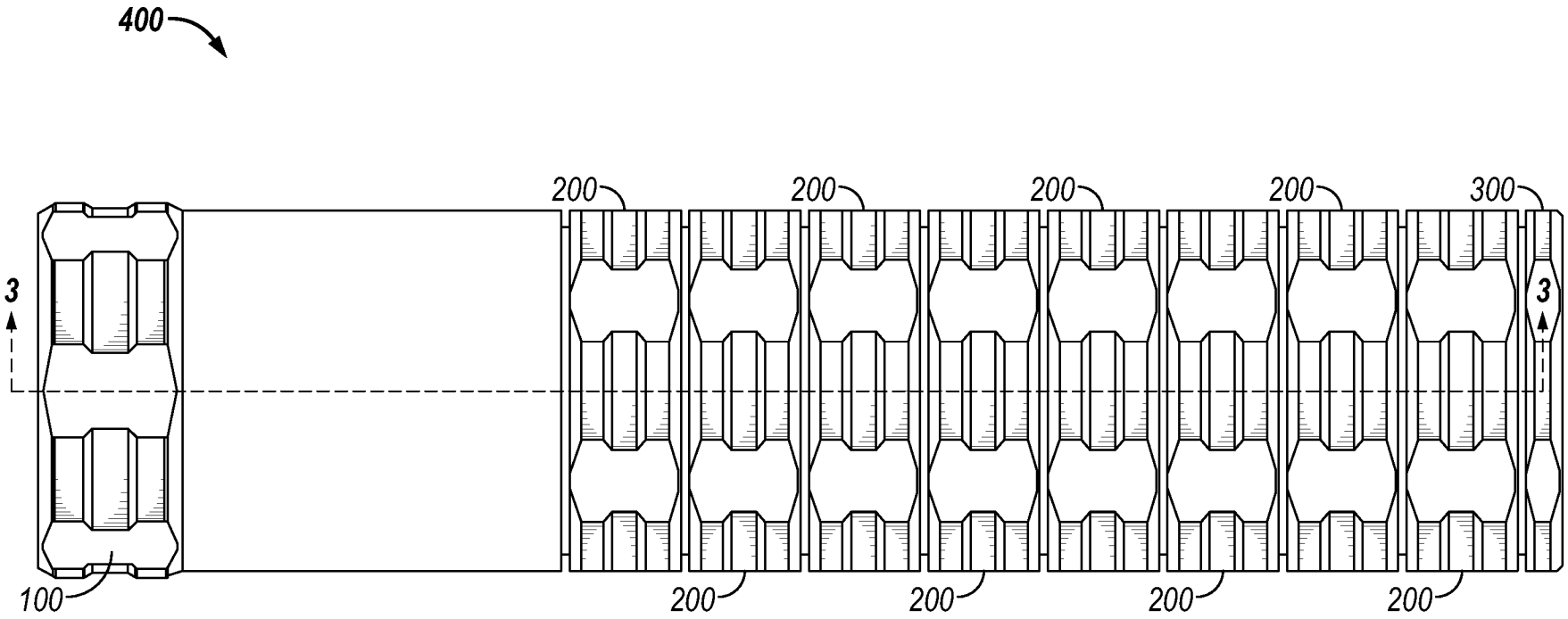
FIG. 1 is a schematic of an embodiment of a firearm suppressor.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows an embodiment of firearm suppressor 400. The firearm suppressor 400 may be used to suppress the discharge of a firearm such as, but not limited to, a rifle, a muzzle loader, a shotgun, a pistol, a revolver, or the like. The firearm suppressor 400 includes a base 100 that is configured to connect the suppressor to the barrel of a firearm. For example, the base 100 may thread onto a threaded barrel of a firearm or a threaded connector attached to the barrel of a firearm. As yet another example, the base 100 may be configured to connect to one or more lugs on a connector attached to the barrel of a firearm as would be appreciated by one of ordinary skill in the art having the benefit of this disclosure. The suppressor 400 includes a plurality of baffles 200 and an end cap 300. The baffles 200 are positioned between the base 100 and the end cap 300. The baffles 200 may be modular enabling the user to shorten or lengthen the overall length of the suppressor 400 may changing the number of baffles 200 between the base 100 and the end cap 300.

The suppressor 400 includes a continuous bore formed from the baffles 200 and the end cap 300 as discussed herein. The continuous bore does not include any appreciable gaps into which a wad may expand into as the wad travels through the suppressor 400, if the suppressor is connected to a shotgun. The base 100 and a baffle 200 of the suppressor 400 could be incorporated into a single unit as would be appreciated by one of ordinary skill in the art having the benefit of this disclosure. Likewise, the end cap 300 and a baffle 200 of the suppressor 400 could be incorporated into a single unit as would be appreciated by one of ordinary skill in the art having the benefit of this disclosure. In an alternative configuration, the baffles 200 could be positioned within a housing, or can, that extends between the base 100 and the end cap 300.

Figure 2:
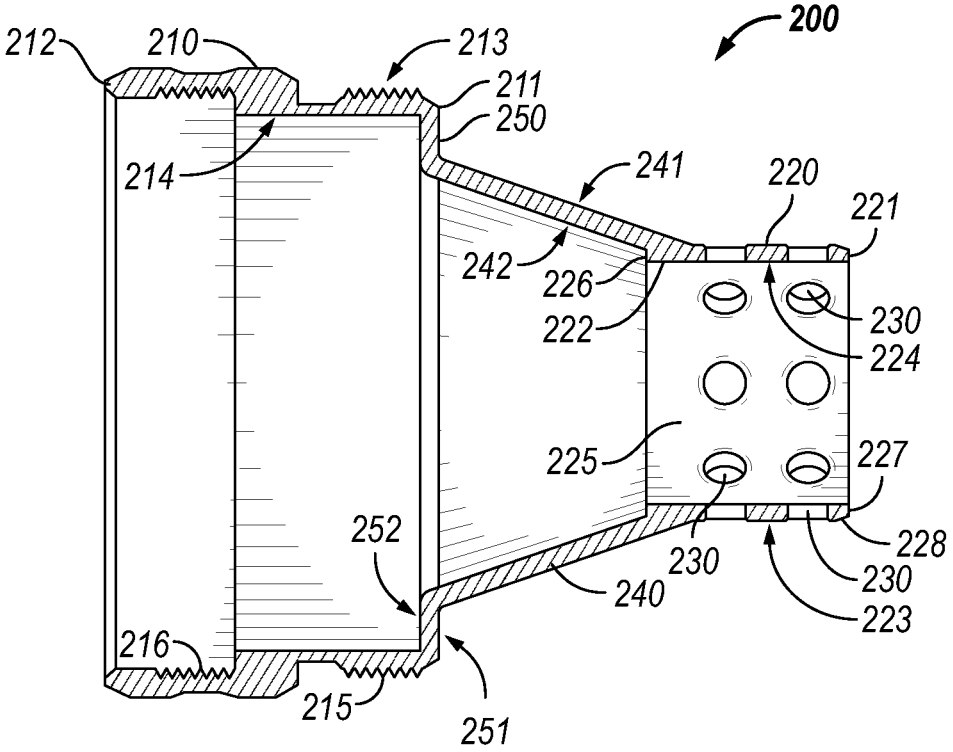
FIG. 2 is a cross-sectional view of an embodiment of a baffle.

FIG. 2 is a cross-section view of an embodiment of a baffle 200 that may be used within a firearm suppressor 400. The baffle 200 includes a lower cylindrical portion 210 having a first end 211, a second end 212, an exterior 213, and an interior 214. The lower cylindrical portion 210 includes external threads 215 configured to connect the baffle 200 to another baffle 200 or another component of a suppressor 400 such as a base 100. The lower cylindrical portion 210 includes internal threads 216 configured to connect the baffle 200 to another baffle 200 or another component of a suppressor 400 such as an end cap 300. The baffle 200 includes an upper cylindrical portion 220 having a first end 221, a second end 222, an exterior 223, an interior 224, and a central bore 225 that extends through the upper cylindrical portion 220, the central bore 225 being defined by the interior 224 of the upper cylindrical portion 220. The baffle 200 includes a plurality of holes 230 through the upper cylindrical portion 220.

The baffle 200 includes a cone, or cup, portion 240 between the upper cylindrical portion 220 and the lower cylindrical portion 210. The cone portion 240 includes an exterior 241 and an interior 242. The plurality of holes 230 provide fluid communication between the interior 214 of the upper cylindrical portion 210 and the exteriors 213, 241 of the upper cylindrical portion 210 and the cone portion 240. The plurality of holes 230 enable the expansion of gas from the discharge of a projectile, such as but not limited to, a shotgun shell, to expand out of the interior 214 of the upper cylindrical portion 210. The expansion of gas helps to suppress the noise created by the discharge of a projectile as would be appreciated by one of ordinary skill in the art having the benefit of this disclosure. However, the plurality of holes 230 are too small for a wad to expand through if used one a shotgun with shells having a wad.

The baffle 200 includes a horizontal portion 250 connected between the cone portion 240 and the first end 211 of the lower cylindrical portion 210. The horizontal portion 250 includes an exterior 251 and an interior 252. The plurality of holes 230 also provides fluid communication between the interior 214 of the upper cylindrical portion 210 and the exterior 251 of the horizontal portion 250. Alternatively, the cone portion 240 could be directly connected to the lower cylindrical portion 210 as would be appreciated by one of ordinary skill in the art having the benefit of this disclosure.

The baffle 200 includes an internal shoulder 226 located adjacent the second end 222 of the upper cylindrical portion 220 and adjacent to the cone portion 240. The first end 221 of the upper cylindrical portion 220 of the baffle 200 includes a flat or surface 227 and a chamfer 228. The first end 221 of the upper cylindrical portion 220 of the baffle 200 is configured to mate with a portion of an adjacent baffle 200. Specifically, the surface 227 of the first end 221 of the upper cylindrical portion 220 is configured to mate with or engage with the internal shoulder 226 of an adjacent baffle 200. Likewise, the chamfer 228 is configured to mate with or engage a portion of the interior 242 of the cone portion 240 of the adjacent baffle 200. Likewise, the end cap 300 is configured to mate with or engage the internal shoulder 226 and a portion of the interior 242 of the cone portion 240 of an adjacent baffle 200 as discussed herein. The engagement between the baffles 200 and the end cap 300 form a continuous bore through the suppressor 400 without any appreciable gaps into which a discharged wad may expand into, if used to suppress the discharge of a shotgun shell in a shotgun.

Figure 3:
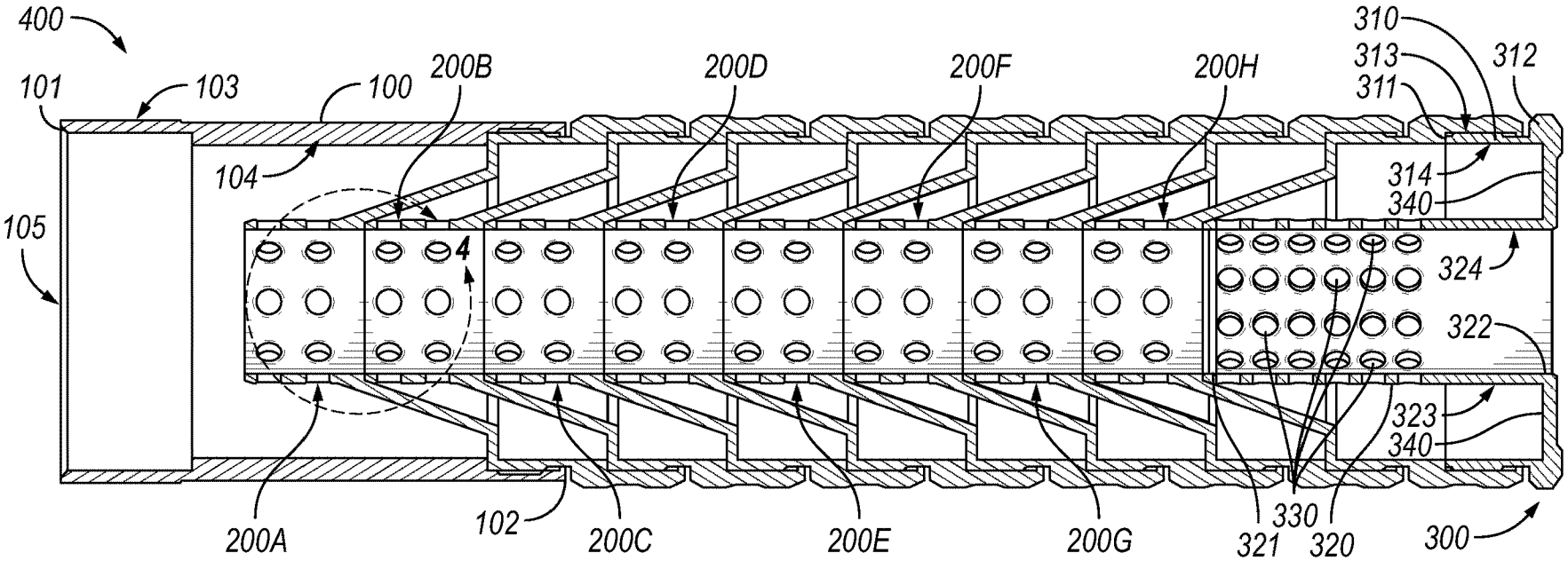
FIG. 3 is a cross-sectional view of the firearm suppressor of FIG. 1.

FIG. 3 is cross-sectional view of an embodiment of a firearm suppressor 400. The suppressor 400 includes a base 100 that has a first end 101, a second end 102, and exterior 103, an interior 104, and a bore, or passageway, 105 that is defined by the interior 104. The base 100 is configured to be selectively connected to the muzzle end of a barrel of a firearm, such as a shotgun barrel, and the bore 105 provides a path through which the projectile, or shot and a wad if used with a shotgun, may travel after being discharged from a firearm.

The suppressor 400 includes a first baffle 200A, second baffle 200B, third baffle 200C, fourth baffle 200D, fifth baffle 200E, sixth baffle 200F, seventh baffle 200G, and an eighth baffle 200H. Each baffle 200A-200H includes the components as detailed in FIG. 2. For example, the first baffle 200A includes a first lower cylindrical portion, a first upper cylindrical portion, a first central bore that extends through the first upper cylindrical portion, and a first plurality of holes through the first upper cylindrical portion 220. The first baffle 200A further includes a first cone portion between the first upper cylindrical portion and the first lower cylindrical portion. The first plurality of holes provides fluid communication between the interior of the first upper cylindrical portion and the exteriors of the first upper cylindrical portion and the first cone portion. The first baffle 200A includes a first horizontal portion connected between the first cone portion and the first end of the first lower cylindrical portion.

Likewise, the second baffle 200B includes a second lower cylindrical portion, a second upper cylindrical portion, a second central bore, a second plurality of holes, a second cone portion, and a second horizontal portion. The third baffle 200C includes third lower cylindrical portion, a third upper cylindrical portion, a third central bore, a third plurality of holes, a third cone portion, and a third horizontal portion. The total number of baffles 200A-H shown in FIG. 3 is shown for illustrative purposes and may be varied to be more or less than eight (8) as would be appreciated by one of ordinary skill in the art having the benefit of this disclosure.

The suppressor 400 includes an end cap 300 connected to the eighth baffles 200H. The end cap 300 includes an outer cylindrical portion 310 that has a first end 311, a second end 312, an exterior 313, and an interior 314. The end cap 300 includes an inner cylindrical portion 320 having a first end 321, a second end 322, an exterior 323, an interior 324, and a central bore 325. The end cap 300 includes a horizontal portion 340 connected between the second end 312 of the outer cylindrical portion 310 and the second end 322 of the inner cylindrical portion 320. The end cap 300 incudes a plurality of holes 330 in the inner cylindrical portion 320. The plurality of holes 330 provide fluid communication between the interior 324 of the inner cylindrical portion 320 and the exterior 323 of the inner cylindrical portion 320. The plurality of holes 330 enable the expansion of gas from the discharge of a shotgun shell into the exterior of the inner cylindrical portion 320. The expansion of gas helps to suppress the noise created by the discharge of a projectile (e.g., bullet, shotgun shell, round, ammunition, shot, cartridge) as would be appreciated by one of ordinary skill in the art having the benefit of this disclosure. However, the plurality of holes 330 are too small for a wad to expand through if used with a shotgun shell having a wad.

The central bore 325 of the inner cylindrical portion 320 of the end cap 300 is aligned with the central bores 225 of the baffles 200A-200H of the suppressor 400. The first end 321 of the inner cylindrical portion 320 of the end cap 300 is configured to mate or engage with a portion of an adjacent baffle 200 to so that the interior 324 of the inner cylindrical portion 320 forms part of a continuous bore with the interior 224 of the upper cylindrical portion 220 of the adjacent baffle 200. The first end 321 of the inner cylindrical portion 320 includes a flat or surface 327 that is configured to mate or engage with the internal shoulder 226 of the adjacent baffle 200. The first end 321 of the inner cylindrical portion 320 also includes a chamfer 328 that is configured to engage or mate with the interior 242 of the cone portion 240 of the adjacent baffles 200. In the embodiment of the suppressor 400 shown in FIG. 3, the eighth baffle 200H is positioned adjacent to the end cap 300.

Figure 4:
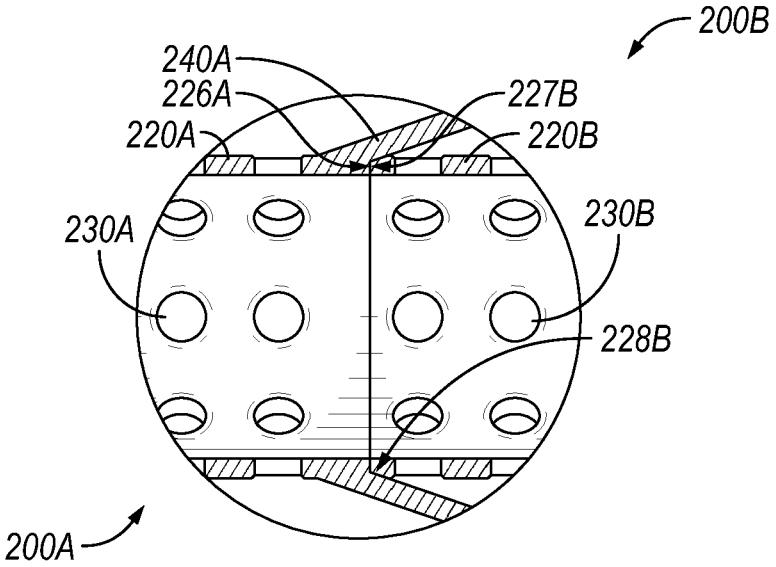
FIG. 4 is close-up view of a portion of the cross-sectional view of FIG. 2.

FIG. 4 is a close-up view of the cross-sectional view of FIG. 3. FIG. 4 shows the interface between the first baffle 200A and the second baffle 200B. The first end 221B of the second upper cylindrical portion 220B of the second baffle 200B engages the first upper cylindrical portion 220A and the first cone portion 240A of the first baffle 200A to form part of a continuous bore through the suppressor 400. The second surface 227B of the second baffle 200B engages the first internal shoulder 226A of the first baffle 200A. Additionally, the second chamfer 228B of the second baffles 200B engages the interior 241A of the first cone portion 240A of the first baffle 200A. The first upper cylindrical portion 220A includes a first plurality of holes 230A and the second upper cylindrical portion 220B includes a second plurality of holes 230B each of which enable gas from a discharged projectile to expand out of the continuous bore of the suppressor 400 as discussed herein.

Figure 5:
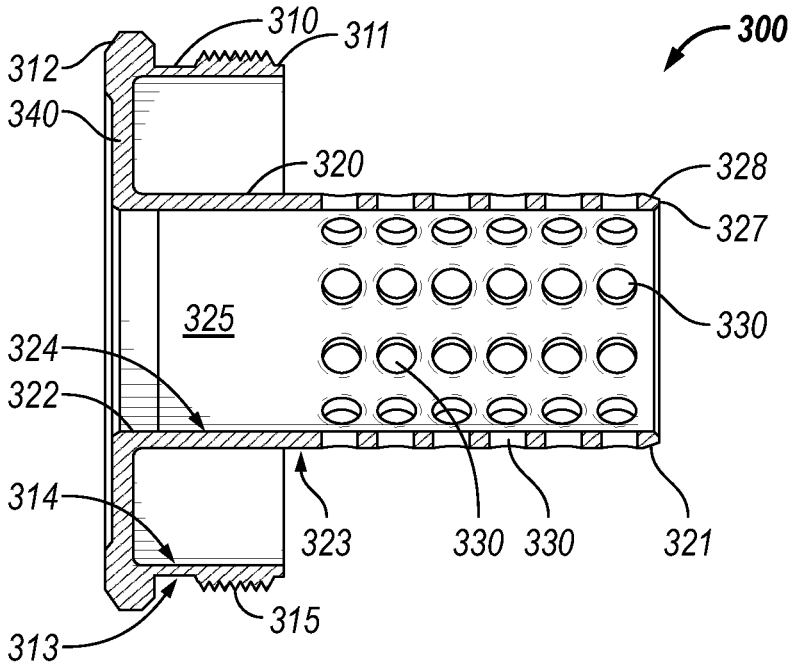
FIG. 5 is a cross-sectional view of an embodiment of an end cap.

FIG. 5 is a cross-sectional view of an embodiment of an end cap 300. The end cap 300 includes an outer cylindrical portion 310 that has a first end 311, a second end 312, an exterior 313, and an interior 314. The exterior 313 includes external threads 315 configured to connect the end cap 300 to a baffle 200 of the firearm suppressor 400. The end cap 300 includes an inner cylindrical portion 320 having a first end 321, a second end 322, an exterior 323, an interior 324, and a central bore 325. The end cap 300 includes a horizontal portion 340 connected between the second end 312 of the outer cylindrical portion 310 and the second end 322 of the inner cylindrical portion 320. The end cap 300 incudes a plurality of holes 330 in the inner cylindrical portion 320. The plurality of holes 330 provide fluid communication between the interior 324 of the inner cylindrical portion 320 and the exterior 323 of the inner cylindrical portion 320. The plurality of holes 330 enable the expansion of gas from the discharge of a round, such as a shotgun shell, into the exterior of the inner cylindrical portion 320. The expansion of gas helps to suppress the noise created by the discharge of a round as would be appreciated by one of ordinary skill in the art having the benefit of this disclosure. However, the plurality of holes 330 are too small for a wad to expand through if used on a shotgun.

As discussed herein, the central bore 325 of the inner cylindrical portion 320 of the end cap 300 is aligned with the central bores 225 of the baffles 200 when connected to the suppressor 400. The first end 321 of the inner cylindrical portion 320 of the end cap 300 is configured to mate or engage with a portion of an adjacent baffle 200 to so that the interior 324 of the inner cylindrical portion 320 forms part of a continuous bore with the interior 224 of the upper cylindrical portion 220 of the adjacent baffle 200. The first end 321 of the inner cylindrical portion 320 includes a flat or surface 327 that is configured to mate or engage with the internal shoulder 226 of the adjacent baffle 200. The first end 321 of the inner cylindrical portion 320 also includes a chamfer 328 that is configured to engage or mate with the interior 242 of the cone portion 240 of the adjacent baffles 200.

Figure 6:
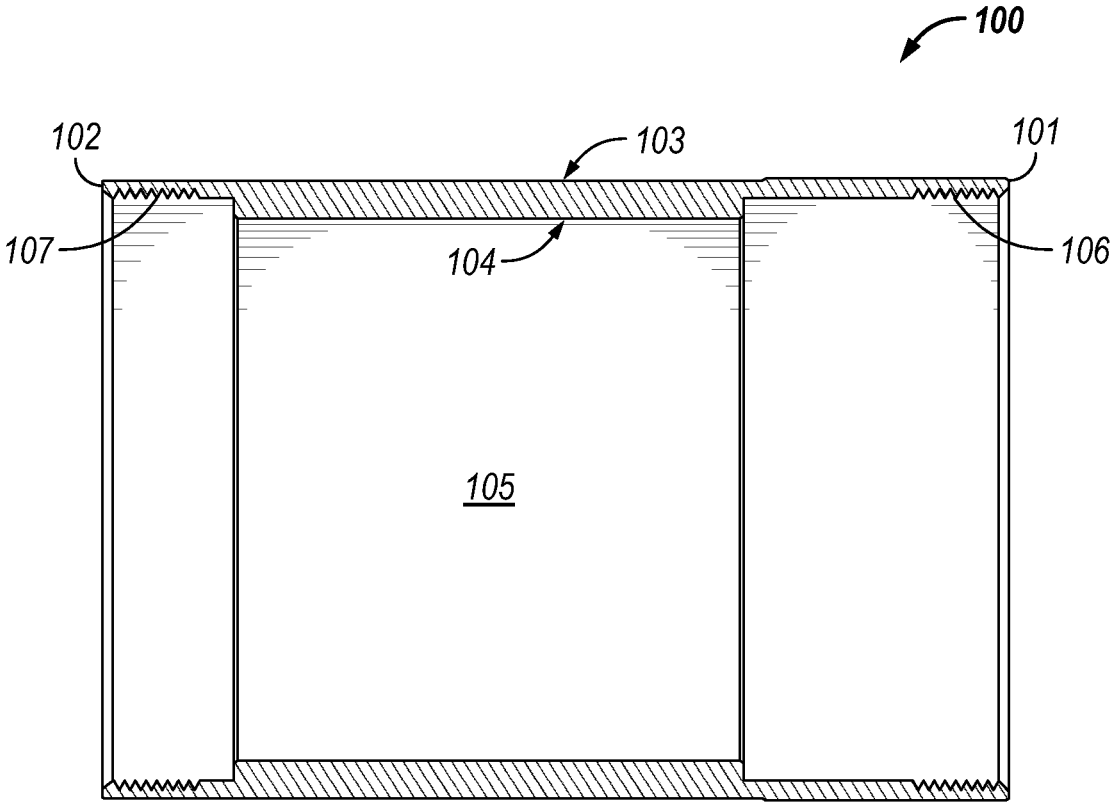
FIG. 6 is a cross-sectional view of an embodiment of a base.

FIG. 6 is a cross-sectional view of an embodiment of an end cap 300. The end cap 300 includes a first end 101, a second end 102, an exterior 103, an interior 104, and a bore 105. The base 100 includes internal threads 106 at the first end 101 of the bore 105. The internal threads 106 are configured to connect the base 100 to a component of a firearm suppressor 400 such as a connector 500 as discussed herein. The base 100 includes internal threads 107 at the second end 102. The internal threads 107 are configured to connect the base 100 to a baffle 200 of the firearm suppressor 400.

Figure 7:
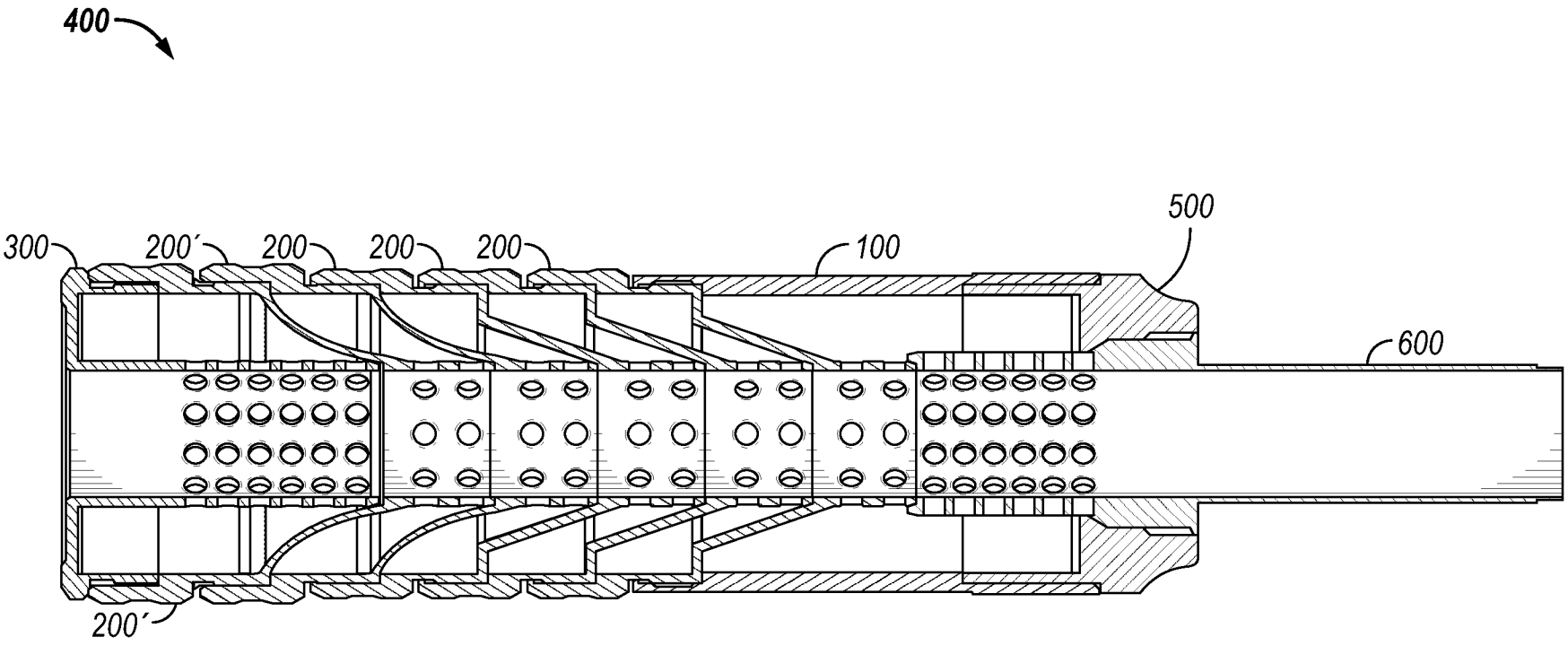
FIG. 7 is a cross-sectional view of an embodiment of a firearm suppressor.

FIG. 7 is cross-sectional view of an embodiment of a firearm suppressor 400. The suppressor 400 includes a base 100. The base 100 is configured to be selectively connected to a shotgun via a connector 500 and a shotgun mount 600 as discussed herein. The base 100 may be configured to be selectively connected to a firearm other than a shotgun as would be appreciated by one of ordinary skill in the art having the benefit of this disclosure. The suppressor 400 includes a plurality of baffles 200, 200' positioned between the base 100 and an end cap 300. Some of the baffles 200 includes a lower cylindrical portion 210, an upper cylindrical portion 220, a central bore 225 that extends through the upper cylindrical portion 220, and a plurality of holes 230 through the upper cylindrical portion 220 as shown in FIG. 2. The baffles 200 further includes a cone portion 240 between the upper cylindrical portion 220 and the lower cylindrical portion 210. The plurality of holes 230 provides fluid communication between the interior 224 of the upper cylindrical portion 220 and the exteriors 223, 241 of the upper cylindrical portion 220 and the first cone portion 240. The baffles 200 includes a horizontal portion 250 connected between the cone portion 240 and a first end 211 of the lower cylindrical portion 210.

Some of the baffles 200' includes a lower cylindrical portion 210, an upper cylindrical portion 220, a central bore 225 that extends through the upper cylindrical portion 220, and a plurality of holes 230 through the upper cylindrical portion 220. The baffles 200' further includes a cone portion 240A between the upper cylindrical portion 220 and the lower cylindrical portion 210. The cone portion 240A is curved, or has a radius, as opposed to the straight cone portions 240 of baffles 200. The cone portion 240A includes an exterior 241A and an interior 242A. The plurality of holes 230 provides fluid communication between the interior 224 of the upper cylindrical portion 220 and the exteriors 223, 241A of the upper cylindrical portion 220 and the cone portion 240A. The cone portion 240A is connected to the first end 211 of the lower cylindrical portion 210 and the second end 222 of the upper cylindrical portion 220.

The suppressor 400 includes an end cap 300 connected to the last baffle 200'. The suppressor 400 includes a connector 500 and a shotgun mount 600. The shotgun mount 600 is configured to thread into the choke threads in the end of a shotgun barrel as discussed herein. The shotgun mount 600 is connected to the base 100 via the connector 500 as discussed herein. A different mount or adapter could be used to connect the base 100 to the barrel of a firearm other than a shotgun, such as but not limited to, a rifle, muzzle loader, or pistol, as would be appreciated by one of ordinary skill in the art having the benefit of this disclosure.

Figure 8:
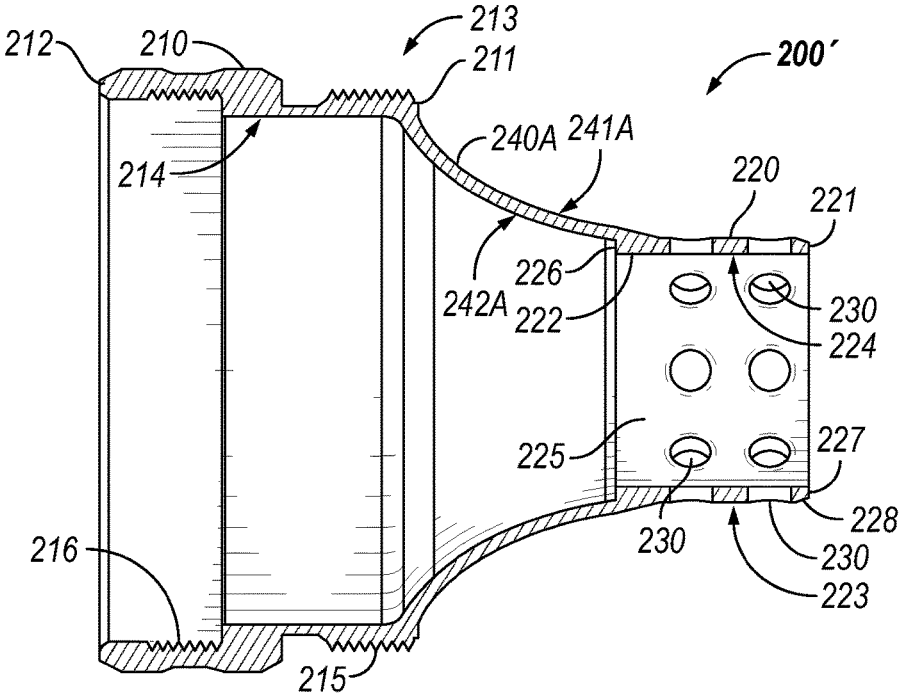
FIG. 8 is a cross-sectional view of an embodiment of a baffle.

FIG. 8 is a cross-section view of an embodiment of a baffle 200' that may be used within a firearm suppressor 400. The baffle 200' includes a lower cylindrical portion 210 having a first end 211, a second end 212, an exterior 213, and an interior 214. The lower cylindrical portion 210 includes external threads 215 configured to connect the baffle 200' to another baffle 200, 200' or another component of a suppressor 400 such as a base 100. The lower cylindrical portion 210 includes internal threads 216 configured to connect the baffle 200' to another baffle 200, 200' or another component of a suppressor 400 such as an end cap 300. The baffle 200' includes an upper cylindrical portion 220 having a first end 221, a second end 222, an exterior 223, an interior 224, and a central bore 225 that extends through the upper cylindrical portion 220, the central bore 225 being defined by the interior 224 of the upper cylindrical portion 220. The baffle 200' includes a plurality of holes 230 through the upper cylindrical portion 220.

The baffle 200 includes a cone, or cup, portion 240A between the upper cylindrical portion 220 and the lower cylindrical portion 210. The cone portion 240A includes an exterior 241A and an interior 242A. The cone portion 240A may be curved having a radius as opposed to the straight cone portion 240 of baffle 200. The cone portion 240A may be connected directly between the lower cylindrical portion 210 and the upper cylindrical portion 220. The plurality of holes 230 provide fluid communication between the interior 214 of the upper cylindrical portion 210 and the exteriors 213, 241A of the upper cylindrical portion 210 and the cone portion 240A. The plurality of holes 230 enable the expansion of gas from the discharge of a shotgun shell to expand out of the interior 214 of the upper cylindrical portion 210. The expansion of gas helps to suppress the noise created by the discharge of a bullet or round, such as a shotgun shell, as would be appreciated by one of ordinary skill in the art having the benefit of this disclosure. However, the plurality of holes 230 are too small for a wad to expand through, if used with a shotgun shell.

The baffle 200' includes an internal shoulder 226 located adjacent the second end 222 of the upper cylindrical portion 220 and adjacent to the cone portion 240. The first end 221 of the upper cylindrical portion 220 of the baffle 200' includes a flat or surface 227 and a chamfer 228. The first end 221 of the upper cylindrical portion 220 of the baffle 200' is configured to mate with a portion of an adjacent baffle 200, 200'. Specifically, the surface 227 of the first end 221 of the upper cylindrical portion 220 is configured to mate with or engage with the internal shoulder 226 of an adjacent baffle 200, 200'. Likewise, the chamfer 228 is configured to mate with or engage a portion of the interior 242 of the cone portion 240, 240A of the adjacent baffle 200, 200'. Likewise, the end cap 300 is configured to mate with or engage the internal shoulder 226 and a portion of the interior 242 of the cone portion 240, 240A of an adjacent baffle 200, 200' as discussed herein. The engagement between the baffles 200, 200', the end cap 300, and the shotgun mount 600 form a continuous bore through the suppressor 400 without any appreciable gaps into which a discharged wad may expand into if used on a shotgun.

Figure 9:
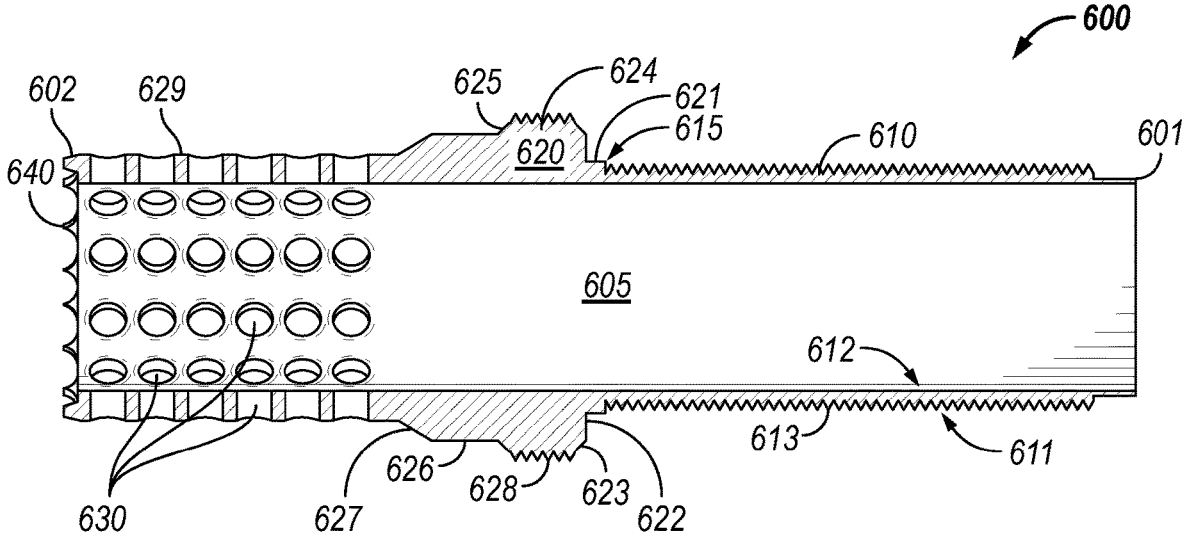
FIG. 9 is a cross-sectional view of an embodiment of a shotgun mount.

FIG. 9 is a cross-section view of a shotgun mount 600. The shotgun mount 600 includes a first end 601 and a second end 602. A first portion 610 of the shotgun mount 600 adjacent to the first end 601 is configured to connect the shotgun mount 600 to the barrel of a shotgun. The first portion 610 includes first exterior threads 611 that are configured to thread into the choke threads of a shotgun barrel to attach the shotgun mount 600 to a shotgun. The shotgun mount 600 includes a central bore 605 that extends from the first end 601 to the second end 602. The shotgun mount 600 includes an interior 612 and an exterior 613. The interior 612 defines the central bore 605. The exterior 613 includes an exterior shoulder 615 adjacent to the exterior threads 611. The end of a shotgun barrel may abut the exterior shoulder 615 when the shotgun mount 600 is threaded into the choke threads of a shotgun barrel.

The shotgun mount 600 includes a second portion 629 adjacent to the second end 602 of the shotgun mount 600. The second portion 629 includes a plurality of apertures 630 that enable fluid communication from the central bore 605 of the shotgun mount 600 to the exterior 613 of the shotgun mount 600. The shotgun mount 600 includes a plurality of breeching teeth 640 located at the second end 602. The shotgun mount 600 may be used to breech a structure such as a door when the shotgun mount 600 is connected to a shotgun barrel without a suppressor 400 being connected to the shotgun mount 600.

The shotgun mount 600 includes a first flat surface 621 adjacent to the exterior shoulder 615. The shotgun mount 600 includes a second exterior shoulder 622 that extends from the first flat surface 621. The shotgun mount 600 includes second exterior threads 628 on a portion between a first chamfer 623 and a second chamfer 625. The second exterior threads 268 are configured to connect the shotgun mount 600 to a connector 500 as discussed herein. The shotgun mount 600 include a second flat surface 626 and a locking chamfer 627. The components 621-627 between the first portion 310 and the second portion 269 of the shotgun mount 600 are configured to enable the shotgun mount 600 to be connected to a suppressor 400 via a connector 500 as discussed herein.

Figure 10:
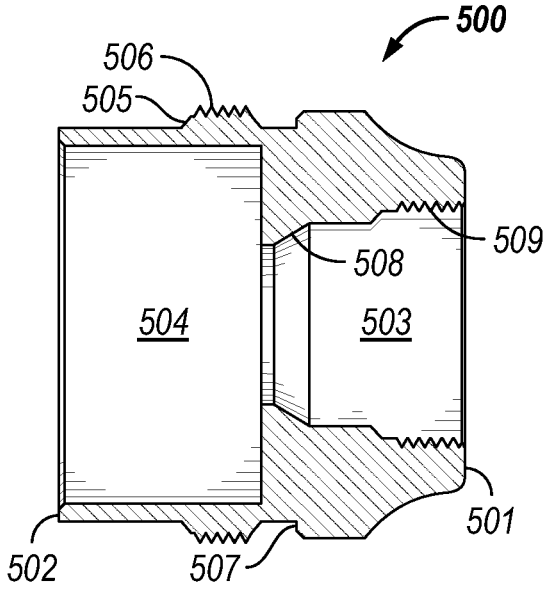
FIG. 10 is a cross-sectional view of an embodiment of a connector.

FIG. 10 is a cross-section view of an embodiment of a connector 500. The connector 500 is used to connect a suppressor 400 to a shotgun mount 600 that is connected to a shotgun barrel via choke threads. The connector 500 includes a first end 601 and a second end 502. The connector 500 includes a first bore 503 adjacent to the first end 501 and a second bore 504 adjacent to the second end 504. The first bore 503 is configured to receive the second end of the shotgun mount 600. The first bore 503 include internal threads 509 that are configured to thread together with the second external threads 628 on the shotgun mount 600. The second end 602 of the shotgun mount 600 extends into the second bore 504 of the connector 500 when the shotgun mount 600 is connected to the connector 500. The first bore 503 includes a taper 508 that engages the locking taper 627 of the connector 500 to ensure that the connector 500 and shotgun mount 600 remain connected together during repeated discharges of shotgun shells in a shotgun.

The connector 500 includes external threads 506 located on an exterior of the connector 500. The external threads 506 are configured to connect with the base 100 of the suppressor 400. The connector 500 includes an external shoulder 507. The external shoulder 507 may be configured to engage a portion of the base 100 connected to the connector 500 via external threads 506.

Figure 11:
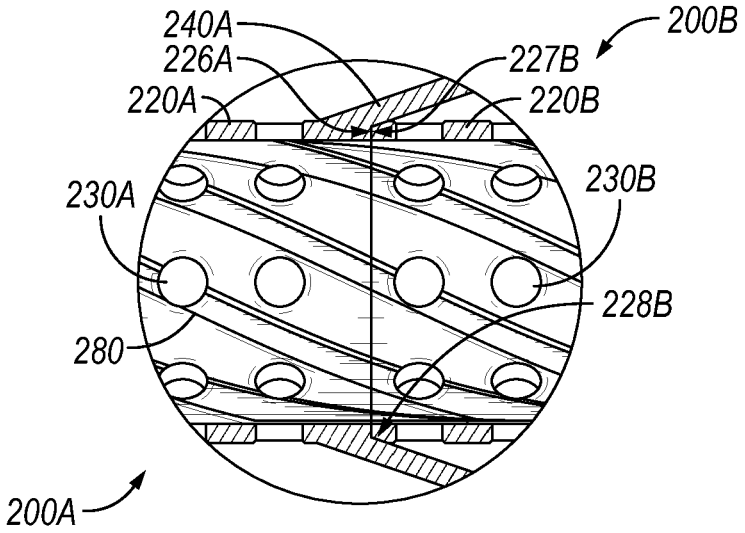
FIG. 11 is a cross-sectional close-up view of embodiments of baffles that include rifling along the bores of the baffles.

FIG. 11 shows the interface between the first baffle 200A and the second baffle 200B. The first end 221B of the second upper cylindrical portion 220B of the second baffle 200B engages the first upper cylindrical portion 220A and the first cone portion 240A of the first baffle 200A to form part of a continuous bore through the suppressor 400. The second surface 227B of the second baffle 200B engages the first internal shoulder 226A of the first baffle 200A. Additionally, the second chamfer 228B of the second baffles 200B engages the interior 241A of the first cone portion 240A of the first baffle 200A. The first upper cylindrical portion 220A includes a first plurality of holes 230A and the second upper cylindrical portion 220B includes a second plurality of holes 230B each of which enable gas from a discharged projectile to expand out of the continuous bore of the suppressor 400 as discussed herein. The bores of the first and second baffles 200A, 200B includes rifling, or grooves, 280 that may be configured to rotate a projectile discharged through the baffles 200A, 200B. The rifling 280 may help to stabilize a projectile as it passes through the baffles 200A, 200B in a suppressor 400.

Figure 12:
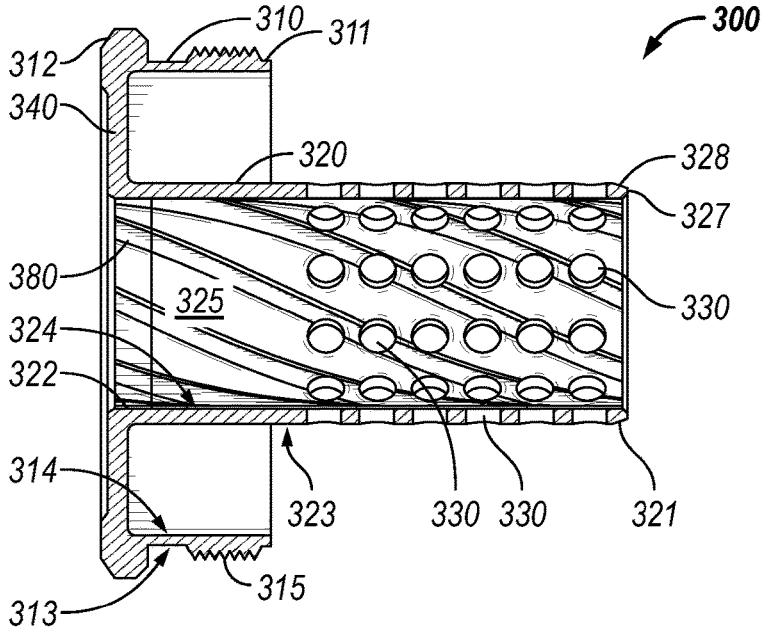
FIG. 12 is a cross-sectional view of an embodiment of an end cap that includes rifling along the bore of the end cap.

FIG. 12 is a cross-sectional view of an embodiment of an end cap 300. The end cap 300 includes an outer cylindrical portion 310 that has a first end 311, a second end 312, an exterior 313, and an interior 314. The exterior 313 includes external threads 315 configured to connect the end cap 300 to a baffle 200 of the firearm suppressor 400. The end cap 300 includes an inner cylindrical portion 320 having a first end 321, a second end 322, an exterior 323, an interior 324, and a central bore 325. The central bore 325 includes rifling, or grooves, 380. The rifling 380 may be configured to rotate, or spin, a projectile discharged through the central bore 325. The rifling 380 may help to stabilize a projectile as it passes through the inner cylindrical portion 320 of the end cap 300. The end cap 300 includes a horizontal portion 340 connected between the second end 312 of the outer cylindrical portion 310 and the second end 322 of the inner cylindrical portion 320. The end cap 300 incudes a plurality of holes 330 in the inner cylindrical portion 320. The plurality of holes 330 provide fluid communication between the interior 324 of the inner cylindrical portion 320 and the exterior 323 of the inner cylindrical portion 320. The plurality of holes 330 enable the expansion of gas from the discharge of a projectile into the exterior of the inner cylindrical portion 320. The expansion of gas helps to suppress the noise created by the discharge of a projectile as would be appreciated by one of ordinary skill in the art having the benefit of this disclosure.

As discussed herein, the central bore 325 of the inner cylindrical portion 320 of the end cap 300 is aligned with the central bores 225 of the baffles 200 when connected to the suppressor 400. The first end 321 of the inner cylindrical portion 320 of the end cap 300 is configured to mate or engage with a portion of an adjacent baffle 200 to so that the interior 324 of the inner cylindrical portion 320 forms part of a continuous bore with the interior 224 of the upper cylindrical portion 220 of the adjacent baffle 200. The first end 321 of the inner cylindrical portion 320 includes a flat or surface 327 that is configured to mate or engage with the internal shoulder 226 of the adjacent baffle 200. The first end 321 of the inner cylindrical portion 320 also includes a chamfer 328 that is configured to engage or mate with the interior 242 of the cone portion 240 of the adjacent baffles 200.

Figure 13:
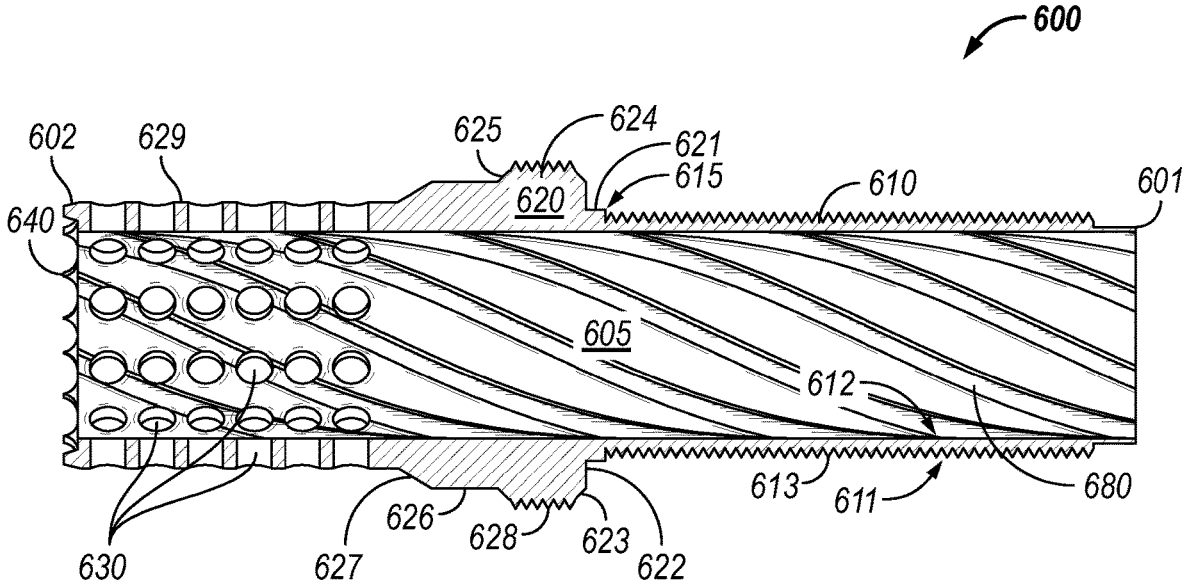
FIG. 13 is a cross-sectional view of an embodiment of a shotgun mount that includes rifling along the bore of the shotgun mount.

FIG. 13 is a cross-section view of a shotgun mount 600. The shotgun mount 600 includes a first end 601 and a second end 602. A first portion 610 of the shotgun mount 600 adjacent to the first end 601 is configured to connect the shotgun mount 600 to the barrel of a shotgun. The first portion 610 includes exterior threads 611 that are configured to thread into the choke threads of a shotgun barrel to attach the shotgun mount 600 to a shotgun. The shotgun mount 600 includes a central bore 605 that extends from the first end 601 to the second end 602. The shotgun mount 600 includes an interior 612 and an exterior 613. The interior 612 defines the central bore 605. The central bore 605 includes rifling 680 configured to impart rotation, or spin, on a projectile, such as a slug, that travels through the central bore 605.

The inner cylindrical portion 320 of the end cap 300 of the suppressor 400 may be configured to act as standard shotgun choke. Some standard shotgun chokes are a cylinder choke, an improved cylinder choke, a modified choke, and a full choke as would be appreciated by one of ordinary skill in the art having the benefit of this disclosure. A cylinder choke is typically an unconstructed barrel that allows the shot from a discharge shotgun shell to spread quickly. The inner cylindrical portion 320 of the end cap 300 shown in FIG. 5 may be configured as a cylinder choke.

Figure 14:
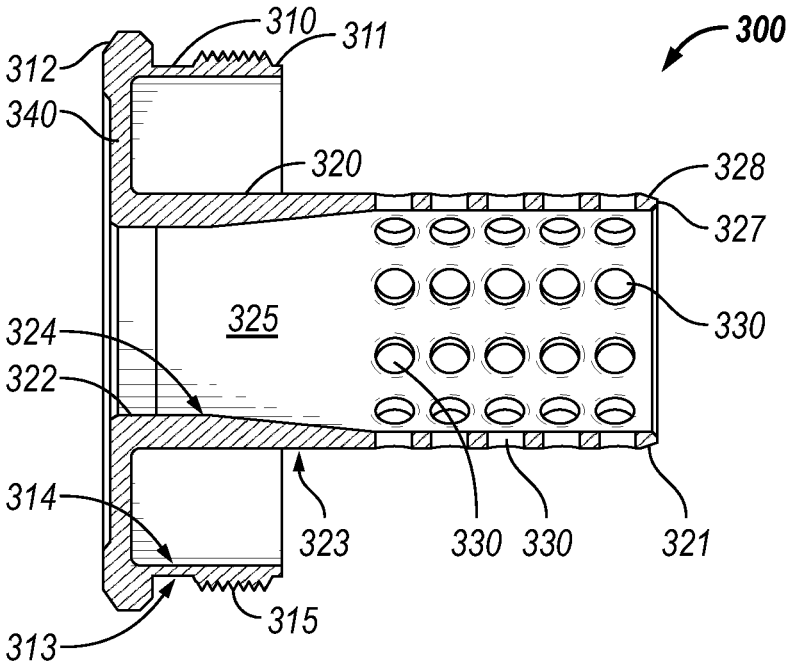
FIG. 14 is a cross-sectional view of an embodiment of an end cap.

An improved cylinder choke has a slight constriction. In other words, the wall thickness of a portion the improved cylinder choke is slightly increased causing the inner diameter of the bore of a cylinder choke to decrease. The slight constriction still allows the shot from a discharged shotgun sell to spread fairly quickly, but not as quickly as a cylinder choke. FIG. 14 shows an embodiment of an end cap 300 with the inner cylindrical portion 320 configured as an improved cylinder choke. The rest of the components of the end cap 300 of FIG. 14 may be substantially identical to other end cap 300 embodiments discussed herein.

Figure 15:
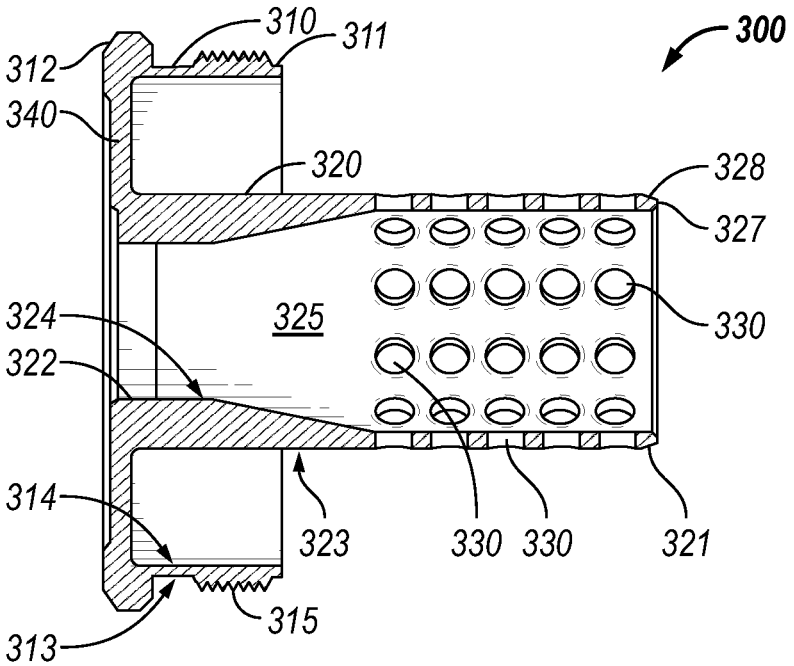
FIG. 15 is a cross-sectional view of an embodiment of an end cap.

A modified choke has a moderate constriction. In other words, the wall thickness of a portion of the moderate choke is increased more than an improved cylinder choke causing the inner diameter of the bore to decrease with respect to the improved cylinder choke. The shot stays together longer when discharged through a modified choke in comparison to an improved cylinder choke. FIG. 15 shows an embodiment of an end cap 300 with the inner cylindrical portion 320 configured as a moderate choke. The inner cylindrical portion 320 could also be configured as an improved modified choke as would be appreciated by one of ordinary skill in the art having the benefit of this disclosure. The rest of the components of the end cap 300 of FIG. 15 may be substantially identical to other end cap 300 embodiments discussed herein.

Figure 16:
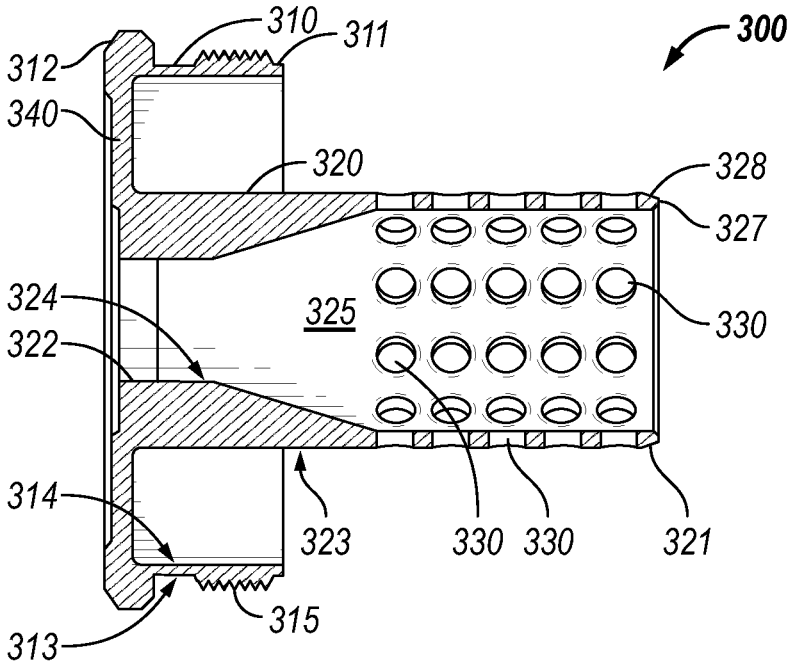
FIG. 16 is a cross-sectional view of an embodiment of an end cap.

A full choke has a tight constriction. In other words, the wall thickness of a portion of the full choke is increased more than the modified choke or the improved modified choke causing the inner diameter of the bore to decrease with respect to the both the modified choke and the improved modified choke. The shot stays together even longer when discharged through a full choke in comparison to a modified choke or an improved modified choke. FIG. 16 shows an embodiment of an end cap 300 with the inner cylindrical portion 320 configured as a full choke. The rest of the components of the end cap 300 of FIG. 16 may be substantially identical to other end cap 300 embodiments discussed herein.

Figure 17:
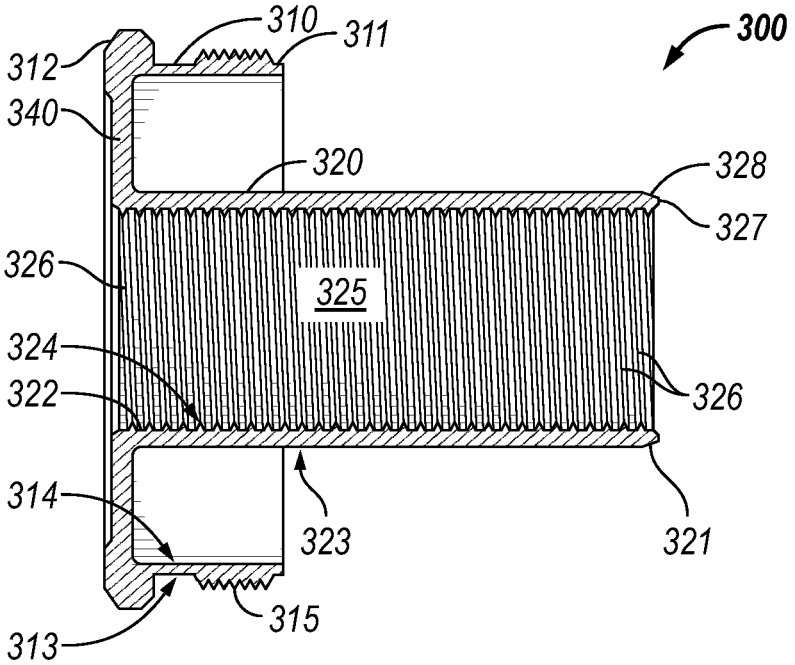
FIG. 17 is a cross-sectional view of an embodiment of an end cap.

FIG. 17 is a cross-sectional view of an embodiment of an end cap 300 that includes internal threads 326 that run from substantially the first end 321 to the second end 322 along the interior 324. The threads 326 are configured to enable a choke, such as but not limited to a cylinder choke, improved cylinder choke, a modified choke, an improved modified choke, or a full choke to be threaded into the inner cylindrical portion 320 of the end cap 300. The threads 326 enable different chokes to be inserted into the end cap 300 to change the shot pattern when it leaves the suppressor 400 via the end cap 300.

Figure 18:
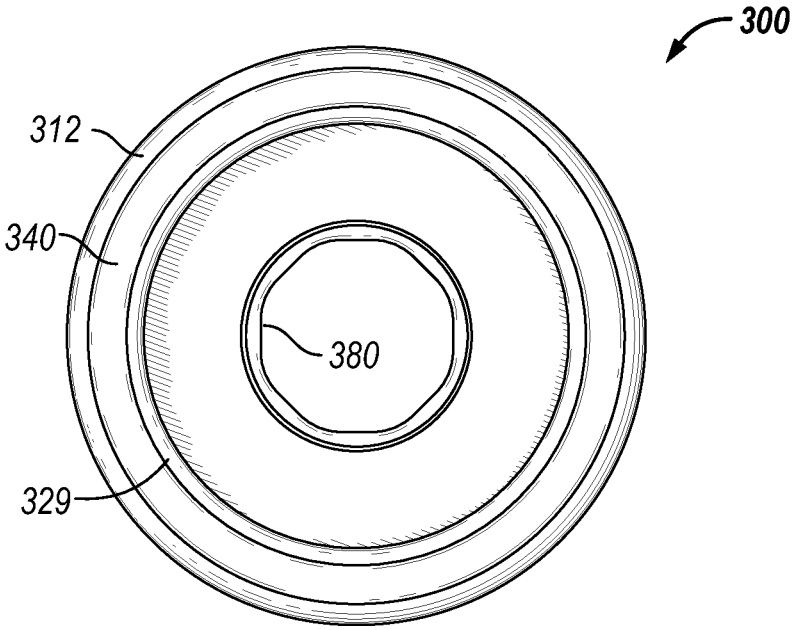
FIG. 18 is an end view of an embodiment of an end cap.

As discussed above, the interior 324 of the bore 325 through the inner cylindrical portion 320 of the end cap 300 may include rifling, or grooves, that help to impart spin on a projectile traveling the bore 325 of the end cap 320. The rifling may improve the aerodynamic stability of a fired projectile from a firearm connected to a suppressor 400 that includes an end cap 300 with rifling. The twist rate of the rifling may be varied depending on the firearm, ammunition, and intended application as would be appreciated by one of ordinary skill in the art having the benefit of this disclosure. The end cap 300 would enable a user to implement rifling 380 in an end cap 300 that is the same or differs than rifling in the barrel of a firearm. The end cap 320 is interchangeable and end caps 320 having different rifling may be used in connection with the same suppressor 400. In this instance, the same suppressor 400 may be used on different firearms and/or with different ammunition by simply switching out the end cap 300 with a second end cap with desire rifling. For example, one end cap 300 may have a smooth bore 325 whereas another end cap 300 may have three (3) groove or seven (7) groove rifling. In another instance, the inner cylindrical portion 320 of the end cap 300 may have polygonal rifling, such as octagonal rifling 380 as shown in FIG. 18.

Figure 19:
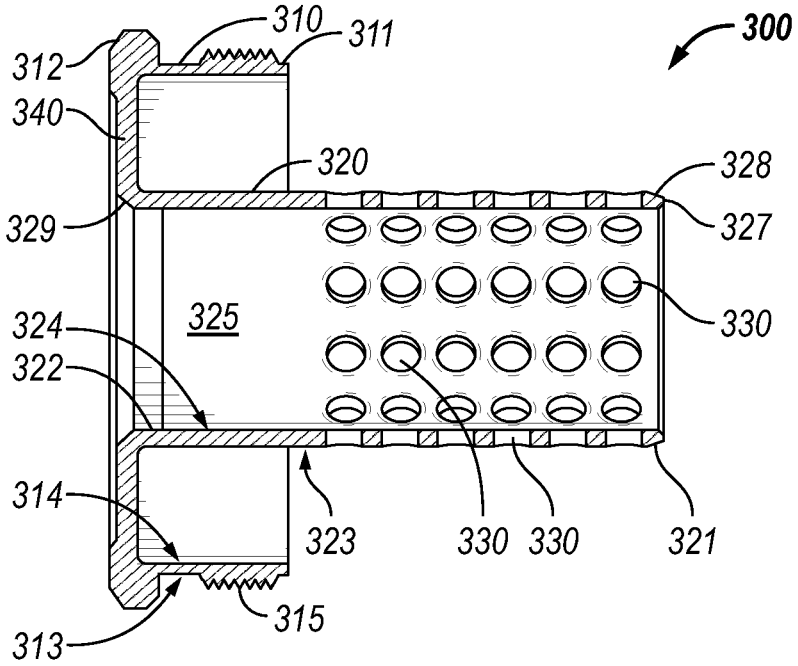
FIG. 19 is a cross-sectional view of an embodiment of an end cap.

FIG. 19 is a cross-sectional view of an embodiment of an end cap 300 that includes a crown 329 at the second end 322 of the inner cylindrical portion 320. The crown on a barrel is designed to moderate the gases from the discharge of the projectile to be concentric with the projectile as it leaves the barrel. There are different crowns available, such as but not limited to, flat, eleven (11) degree target, recessed target, standard, and deep recessed as would be appreciated by one of ordinary skill in the art having the benefit of this disclosure. The addition of a suppressor 400 connected to the muzzle end of the barrel of a firearm may defeat the intended purpose of the crown on the barrel. The end cap 300 of FIG. 19 includes a crown 329. As the end cap 300 of the suppressor 400 may be interchanged with an end cap 300 having a different crown, a user can easily change the crown by swapping out different end caps 300 in the suppressor 400. This easily allows a user to change the crown 329 at the end of the suppressor 400, which is not a feature easily done with a firearm itself.

Likewise, a user cannot change the rifling on a barrel of a firearm without swapping out the barrel or potentially having the interior barrel machined. The end cap 300 of the present disclosure enables a user to easily change the crown and/or rifling at the end the path down the suppressor 400 by simply exchanging the end cap 300. The twist rate of the rifling or even the pattern of the rifling may be changed via a different end cap 300 as would be appreciated by one of ordinary skill in the art having the benefit of this disclosure. As discussed herein, the end cap 300 and baffles 200 may include rifling 380, 280. Also, the optional shotgun mount 600 may include rifling 680. Each of these parts may be interchanged thus enabling the rifling 280, 380 throughout the suppressor 400 to be quickly changed enabling the suppressor 400 to be used with various firearms and ammunition.

Figure 20:
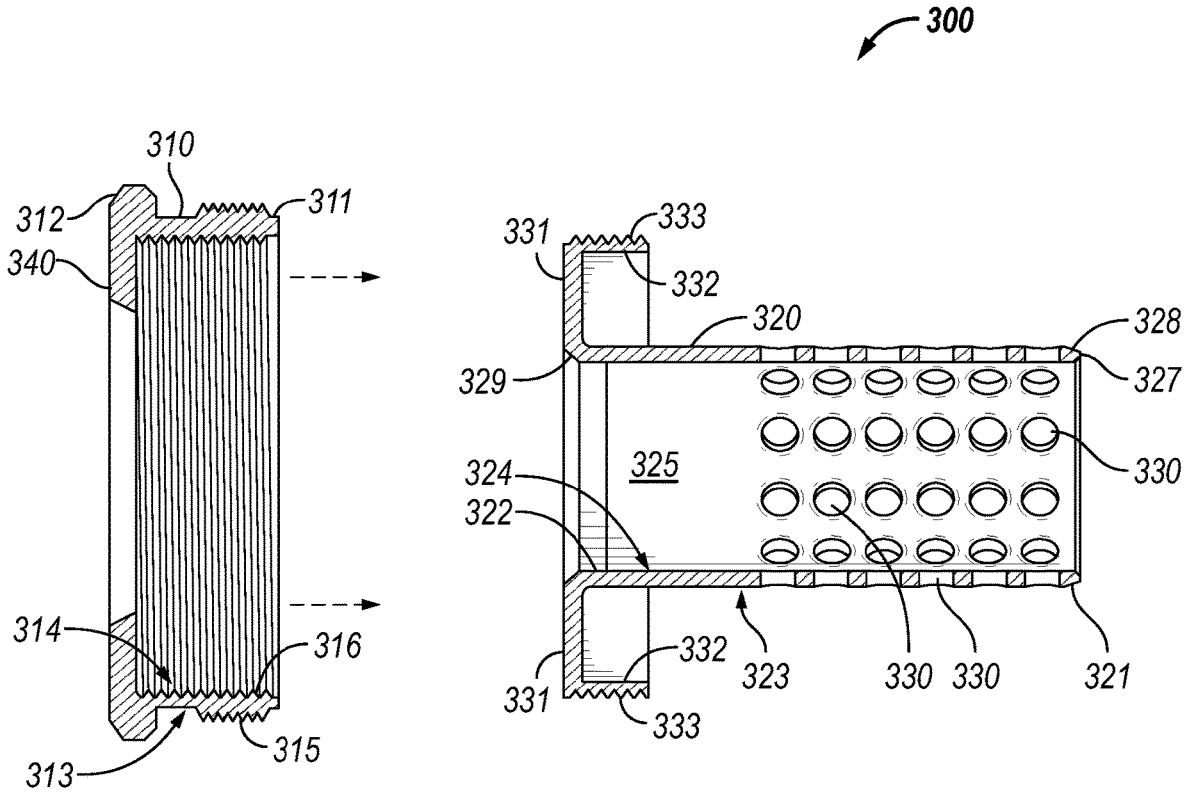
FIG. 20 is a cross-sectional exploded view of an embodiment of an end cap.

FIG. 20 shows a cross-section exploded view of an embodiment of an end cap 300 for a firearm suppressor. The end cap 300 includes an outer cylindrical portion 310 having a first end 311, a second end 312, an exterior 313, and an interior 314. The outer cylindrical portion include external threads 315 on the exterior 313 and internal threads 316 and the interior 314. The external threads 315 are configured to connect the end cap 300 to a baffle 200 of a firearm suppressor 314. An inner cylindrical portion 320 having a first end 321, and second end 322, an exterior 323, an interior 324, and a central bore 325 may be threaded into the outer cylinder portion 310 via the internal threads 316. The inner cylindrical portion 320 is a separate component from the outer cylindrical portion 310 of the end cap 300. The inner cylindrical portion 320 includes external threads 333 configured to mate with the internal threads 316 of the outer cylindrical portion 310. The end cap includes a horizontal portion 340 connected to the second end of the outer cylindrical portion 310.

The inner cylindrical portion 320 includes a horizontal member 331 located at the second end 322 of the inner cylindrical portion 320. The horizontal member 331 extends away from the inner cylindrical portion 320. The horizontal member 331 may be substantially perpendicular to the inner cylindrical portion 320. The inner cylindrical portion 320 includes a vertical member 332 located at the end of the horizontal member 331 that extends away from the horizontal member 311. The vertical member 332 may be substantially parallel to the inner cylindrical portion 320 and extend in the same direction as the first end 321 of the inner cylindrical portion 320. The vertical member 332 includes external threads 333 that are configured to mate with the internal threads 316 of the outer cylindrical portion 310. In this way, different inner cylindrical portions 320 may be swapped out with a single outer cylindrical portion 310 of the end cap 300.

The inner cylindrical portion 320 may include a plurality of holes 330 that provides fluid communication between the bore 325 of the inner cylindrical portion 320 and the exterior of the inner cylindrical portion 323 when the inner cylindrical portion 320 is threaded into the outer cylindrical portion 310. The inner cylindrical portion 320 may be configured to be an improved cylinder choke, a modified choke, a full choke, or the like as discussed herein. As the inner cylindrical portion 320 is threaded into the outer cylindrical portion 310, the inner cylindrical portion 320 may be removed to change the type of choke in the end cap. The interior 324 of the inner cylindrical portion 320 may include rifling as discussed herein. Likewise, an inner cylindrical portion 310 having a bore 325 with a first inner diameter may be swapped with an inner cylindrical portion 310 having a bore 325 with a second inner diameter that differs from the first inner diameter. In this way, the end cap 300 may be used with different firearm suppressors for different calibers and the projectile path through the end cap 310 may be modified by simply swapping out the inner cylindrical portion 320. Likewise, the crown 329 at the second end 322 of the inner cylindrical portion 320 may be modified by swapping out with a different inner cylindrical portion 320 by simply unthreading a first inner cylindrical portion 320 and threading into the outer cylindrical portion 310 a second inner cylindrical portion 320. The threaded inner cylindrical portion 320 enables modification of the end cap 300 and/or firearm suppressor 400 as would be appreciated by one of ordinary skill in the art having the benefit of this disclosure. The first end 321 of the inner cylindrical portion 320 may include a flat or surface 327 that is configured to mate or engage with an internal shoulder 226 of an adjacent baffle 200. The first end 321 of the inner cylindrical portion 320 may also include a chamfer 328 that is configured to engage or mate with an interior 242 of a cone portion 240 of an adjacent baffle 200.

Although this disclosure has been described in terms of certain embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof

What is claimed is:

1. A firearm suppressor comprising:

a first baffle, the first baffle comprising:

a first lower cylindrical portion having a first end, a second end, an exterior, and an interior;

a first upper cylindrical portion having a first end, a second end, an exterior, an interior, and a first central bore that extends through the first upper cylindrical portion, the first central bore defined by the interior of the first upper cylindrical portion;

a first plurality of holes through the first upper cylindrical portion;

a first cone portion between the first upper cylindrical portion and the first lower cylindrical portion, the first cone portion having an exterior and an interior;

wherein the first plurality of holes provides fluid communication between the interior of the first upper cylindrical portion and the exteriors of the first upper cylindrical portion and the first cone portion; and an end cap, the end cap comprising:

an outer cylindrical portion having a first end, a second end, an exterior, and an interior;

an inner cylindrical portion having a first end, a second end, an exterior, an interior, and a central bore;

a portion connected between the second end of the outer cylindrical portion and the second end of the inner cylindrical portion; and a plurality of holes in the inner cylindrical portion, the plurality of holes providing fluid communication between the interior of the inner cylindrical portion and the exterior of the inner cylindrical portion;

wherein the central bore of the inner cylindrical portion is aligned with the first central bore;

a second baffle, the second baffle comprising:

a second lower cylindrical portion having a first end, a second end, an exterior, and an interior;

a second upper cylindrical portion having a first end, a second end, an exterior, an interior, and a second central bore that extends through the second upper cylindrical portion, the second central bore defined by the interior of the second upper cylindrical portion;

a second plurality of holes through the second upper cylindrical portion;

a second cone portion positioned between the second upper cylindrical portion and the second lower cylindrical portion, the second cone portion having an exterior and an interior;

wherein the second plurality of holes provide fluid communication between the interior of the second upper cylindrical portion and the exteriors of the second upper cylindrical portion and the second cone portion; and a base having a first end, a second end, and a passageway through the base from the first end to the second end, the base configured to be connected to a barrel of a firearm, wherein the first baffle and the second baffle are between the base and the end cap;

wherein the entire end cap is located at a first end of the firearm suppressor and the base is located at a second end of the firearm suppressor.

2. The firearm suppressor of claim 1, wherein the interior of the inner cylindrical portion of the end cap includes rifling.

3. The firearm suppressor of claim 2, wherein the interior of the first upper cylindrical portion of the first baffle includes rifling and wherein the interior of the second upper cylindrical portion of the second baffle includes rifling.

4. The firearm suppressor of claim 1, wherein the firearm barrel is a shotgun barrel and further comprising a shotgun mount, the shotgun mount having a first end, a second end, a central bore, first external threads adjacent to the first end, a plurality of apertures adjacent to the second end, second external threads between the first external threads and the plurality of apertures, and wherein the first external threads are configured to thread into choke threads of the shotgun barrel.

5. The firearm suppressor of claim 4, further comprising a connector, wherein the connector is connected to the shotgun mount and is connected to the base, wherein the connector is between the base and the shotgun mount and wherein the base is between the connector and the first and second baffles.

6. The firearm suppressor of claim 5, wherein the first baffle further comprises a first portion connected between the first cone portion and the first end of the first lower cylindrical portion, the first portion having an interior and an exterior and wherein the second baffle further comprises a second portion connected between the second cone portion and the first end of the second lower cylindrical portion, the second portion having an interior and an exterior.

7. The firearm suppressor of claim 6, wherein the interior of the first upper cylindrical portion includes a first internal shoulder.

8. The firearm suppressor of claim 7, wherein the first end of the first upper cylindrical portion includes a first surface and a first chamfer.

9. The firearm suppressor of claim 7, wherein the first end of the second upper cylindrical portion includes a second surface and a second chamfer, wherein the second surface engages the first internal shoulder of the first upper cylindrical portion and wherein the second chamfer engages the interior of the first cone portion.

10. The firearm suppressor of claim 9, wherein the interior of the second upper cylindrical portion includes a second internal shoulder.

11. The firearm suppressor of claim 10, wherein the second end of the inner cylindrical portion of the end cap includes a surface and a chamfer, wherein the surface engages the second internal shoulder of the second upper cylindrical portion and wherein the chamfer engages the interior of the second cone portion.

12. The firearm suppressor of claim 10, further comprising a third baffle, the third baffle comprising:

a third lower cylindrical portion having a first end, a second end, an exterior, and an interior;

a third upper cylindrical portion having a first end, a second end, an exterior, an interior, and a third central bore that extends through the third upper cylindrical portion, the third central bore defined by the interior of the third upper cylindrical portion;

a third plurality of holes through the third upper cylindrical portion;

a third portion connected to the first end of the third lower cylindrical portion, the third portion having an interior and an exterior;

a third cone portion connected to the second end of the third upper cylindrical upper portion and connected to the third portion, the third cone portion having an exterior and an interior;

wherein the third plurality of holes provides fluid communication between the interior of the third upper cylindrical portion and the exteriors of the third upper cylindrical portion, the third cone portion, and the third portion; and wherein the interior of the third upper cylindrical portion includes a third internal shoulder.

13. The firearm suppressor of claim 12, wherein the second end of the inner cylindrical portion of the end cap includes a surface and a chamfer, wherein the surface of the second end of the inner cylindrical portion of the end cap engages the third internal shoulder of the third upper cylindrical portion and wherein the chamfer of the second end of the inner cylindrical portion of the end cap engages the interior of the third cone portion.

14. The firearm suppressor of claim 13, wherein the base includes internal threads located at the second end, the first lower cylindrical portion includes external threads at the first end and internal threads at the second end, the second lower cylindrical portion includes external threads at the first end and internal threads at the second end, the third lower cylindrical portion includes external threads at the first end and internal threads at the second end, and the outer cylindrical portion of the end cap includes external threads.

15. A shotgun suppressor system comprising:

a shotgun mount having a first end, a second end, a central bore, a plurality of apertures adjacent the second end, first external threads, and second external threads, the first external threads being configured to connect the shotgun mount to a barrel of a shotgun via choke threads;

a connector having a first end, a second end, a first bore, a second bore, internal threads in the first bore, and external threads, wherein the connector is connected to the shotgun mount via the internal threads mated with the second external threads of the shotgun mount;

a base having a first end, a second end, and a passageway through the base from the first end to the second end, the base connected to the external threads of the connector;

an end cap, the end cap having an outer cylindrical portion, an inner cylindrical portion having a central bore, a plurality of holes in the inner cylindrical portion, and a portion connected between the outer cylindrical portion and the inner cylindrical portion, wherein the plurality of holes provides fluid communication between an interior of the inner cylindrical portion and an exterior of the inner cylindrical portion; and a plurality of baffles positioned between the base and the end cap wherein the entire end cap is positioned at a first end of the system and the base is positioned at a second end of the system, each of the plurality of baffles comprising:

a lower cylindrical portion having a first end, a second end, an exterior, and an interior;

an upper cylindrical portion having a first end, a second end, an exterior, and an interior;

a plurality of holes through the upper cylindrical portion;

a cone portion positioned between the upper cylindrical portion and the lower cylindrical portion, the cone portion having an exterior and an interior; and a central bore that extends through the upper cylindrical portion, wherein the plurality of holes provides fluid communication between the interior of the upper cylindrical portion and the exteriors of the upper cylindrical portion and the cone portion, wherein the central bore of each baffle of the plurality of baffles is aligned with the central bore of the end cap and wherein the upper cylindrical portions of the plurality of baffles are sequentially positioned to align the central bore of each baffle of the plurality of baffles with the central bore of the end cap to form a continuous bore.

16. The shotgun suppressor of claim 15, wherein the central bore of the inner cylindrical portion of the end cap is configured to be an improved cylinder choke, a modified choke, or a full choke.

17. The shotgun suppressor system of claim 15, wherein each of the baffles of the plurality of baffles further comprises a portion connected between the cone portion and the first end of the lower cylindrical portion.

18. The shotgun suppressor system of claim 15, wherein each of the baffles of the plurality of baffles further comprises a surface and a chamfer at the first end of the upper cylindrical portion and a shoulder on the interior of the upper cylindrical portion, the shoulder being adjacent to the cone portion, the surface being shaped complementary to the shoulder.

19. The shotgun suppressor system of claim 15, wherein the second end of the shotgun mount further includes breeching teeth and wherein the shotgun mount includes a locking chamfer.

* * * * *